US006237152B1

(12) United States Patent
Gootrad

(10) Patent No.: US 6,237,152 B1
(45) Date of Patent: May 29, 2001

(54) POCKETED WATERPROOF GARMENT AND A METHOD FOR PROVIDING SAME

(76) Inventor: Kevin Gootrad, Dearborn Station, #356, 47 W. Polk St., Chicago, IL (US) 60605

( * ) Notice: Subject to any disclaimer, the term of this patent is extended or adjusted under 35 U.S.C. 154(b) by 0 days.

(21) Appl. No.: 09/318,413

(22) Filed: May 25, 1999

(51) Int. Cl.[7] ..... A41D 3/04

(52) U.S. Cl. ..... 2/87; 2/67; 2/77; 2/82; 2/94; 2/108; 2/125; 2/250

(58) Field of Search ..... 2/49.2, 485, 69, 2/108, 94, 102, 67, 2.15, 2.16, 2.17, 93, 247, 2.5, 77, 70, 82, 125, 250, 87; 450/89

(56) References Cited

U.S. PATENT DOCUMENTS

| | | | | |
|---|---|---|---|---|
| 1,712,109 | * | 5/1929 | Hammer | 2/69.5 |
| 2,428,477 | * | 10/1947 | Thompson | 2/69.5 |
| 2,519,126 | * | 8/1950 | Falk | 2/69.5 |
| 2,544,840 | * | 3/1951 | Kowatsch | 2/69.5 |
| 2,709,815 | * | 6/1955 | Nelson | 2/69.5 |
| 3,137,865 | * | 6/1964 | Evans et al. | 2/69.5 |
| 4,293,957 | * | 10/1981 | Melarvie | 2/2.1 |
| 4,665,563 | * | 5/1987 | Harvey | 2/87 |
| 5,173,968 | * | 12/1992 | Fox | 2/244 |
| 5,255,392 | * | 10/1993 | Stanislaw | 2/247 |
| 5,496,205 | * | 3/1996 | Lee | 450/89 |
| 5,592,697 | * | 1/1997 | Young | 2/247 |
| 5,598,586 | * | 2/1997 | Munjone | 2/237 |
| 5,608,916 | * | 3/1997 | Aumann | 2/247 |
| 5,878,441 | * | 3/1999 | Busker et al. | 2/247 |
| 6,049,913 | * | 4/2000 | Harrigan, Jr. | 2/227 |

* cited by examiner

*Primary Examiner*—John J. Calvert
*Assistant Examiner*—Katherine Moran
(74) *Attorney, Agent, or Firm*—Patents +TMS

(57) ABSTRACT

A garment is provided having at least one pocket that is attached to the garment and accessible via a zipper or other fastener that provides access to an interior compartment formed by the pocket as well as a method for providing a garment with a waterproof compartment. The fastener is preferably a waterproof zipper that is attachable via a process requiring the pocket and the zipper to be attached by gluing, stitching and/or heat-sealing the same. As a result, a completely watertight and waterproof pocket is formed allowing the user of the garment to carry items therein that typically may not be exposed to water.

22 Claims, 3 Drawing Sheets

POCKETED WATERPROOF GARMENT AND A METHOD FOR PROVIDING SAME

BACKGROUND OF THE INVENTION

The present invention generally relates to a garment, particularly for use in water-related activities. More specifically, the present invention relates to a garment including one or more pockets that are waterproof to the exterior environment such that an individual wearing the garment may store articles without risk of damage to the articles contained within the pocket. The present invention further relates to a method for making such a garment with waterproof packets.

It is, of course, generally known to provide a variety of garments for use in water-related activities, such as swimming, water skiing, snorkeling, scuba diving, boating, surfing and the like. Individuals engaging in activities in an around the water often carry a number of articles with them. Some of those articles may be electronic in nature and cannot be subjected to certain conditions, such as exposure to, contact with, or immersion in water. Accordingly, these objects, such as cellular telephones, pagers, portable electronic organizers, radios, tape players, compact disc players and the like cannot typically be brought into the water due to the risk of exposure to the components which likely results in damage to the device.

A need, therefore, exists for a garment that allows an individual to bring components typically endangered by immersion or otherwise subjected to water into the water without risk of damage to the device or its components as well as a method for providing such a garment.

SUMMARY OF THE INVENTION

The present invention generally relates to a garment typically suitable for use in or around the water. More specifically, the present invention relates to a garment having one or more pockets that are capable of holding articles in a watertight and waterproof manner.

To this end, in an embodiment of the present invention, a garment is provided. The garment has a front side and a back side attached to form openings at each end wherein the front side is formed of a top ply and a bottom ply. An opening is formed between the top ply and the bottom ply. A pocket has an interior compartment suspended in the opening between the top ply and the bottom ply. A fastener provides access to the interior compartment of the pocket.

In an embodiment, the top ply and the bottom ply are neoprene.

In an embodiment, the back side is formed of a single ply and is attachable to the top ply and the bottom ply of the front side.

In an embodiment, the fastener is a waterproof zipper.

In an embodiment, an adhesive attaches the pocket to the front side.

In an embodiment, a heat sealable tape attaches the pocket to the front side.

In an embodiment, stitching attaches the pocket to the front side.

In an embodiment, the interior compartment of the pocket is formed by an adhesive around at least a portion of a periphery of the pocket.

In another embodiment of the present invention, a garment has a body formed by a material. A pocket is attached to the body and has an interior compartment. The pocket is attached in a waterproof manner. A fastener is attached to the body to provide access to the interior compartment of the pocket.

In an embodiment, sleeves are formed with the body wherein the pocket is attached to one of the sleeves.

In an embodiment, the fastener is a waterproof zipper.

In an embodiment, the pocket is attached to the body by at least one of an adhesive, stitching or heat sealable tape.

In an embodiment, the material of the body is neoprene.

In an embodiment, the body has two layers of material in at least a portion of the body that includes the pocket wherein the pocket is formed between the two layers.

In another embodiment of the present invention, a method for providing a waterproof compartment associated with a garment is provided. The method comprises the steps of: providing a material forming the garment to at least shape and fit a portion of a body of an individual; attaching a pocket to the material wherein the pocket is attached to the material by at least one of an adhesive, stitching or a heat sealable tape providing the waterproof compartment; and providing a fastener associated with the pocket providing access to an interior of the compartment.

In an embodiment, the fastener is a waterproof zipper.

In an embodiment, the material is neoprene.

In an embodiment, at least a portion of the material has two layers.

In an embodiment, the garment is a jacket that has sleeves.

In an embodiment, two layers of the material in at least a portion of the garment are provided. The pocket is positioned between the two layers.

It is, therefore, an advantage of the present invention to provide a garment and a method for providing a garment that is suitable for use in and around the water.

Another advantage of the present invention is to provide a garment and method for providing a garment having one or more pockets for holding articles.

Yet another advantage of the present invention is to provide a garment and a method for providing a garment having one or more pockets that maintain a waterproof and watertight environment for articles carried within the pockets.

And, another advantage of the present invention is to provide a garment and a method for providing a garment that is suitable for use in and around water and having pockets associated with the garment for carrying articles that typically cannot be exposed to water.

A still further advantage of the present invention is to provide a garment and a method for providing a garment that is simple to manufacture.

Another advantage of the present invention is to provide a garment and a method for providing a garment for use in an around the water that is durable.

Additional features and advantages of the present invention are described in, and will be apparent from, the detailed description of the presently preferred embodiments and from the drawings.

DETAILED DESCRIPTION OF THE PRESENTLY PREFERRED EMBODIMENTS

The present invention provides a garment and a method for providing a garment that is particularly suitable for use in, for example, performing water related activities, such as swimming, snorkeling, scuba diving, water-skiing, boating, surfing and other like sports and/or activities. Of course, the environment in which the garment is used is not restrictive of the present invention, and the garment may, of course, be used within any environment or for any activity.

The garment preferably includes at least one pocket that is zippered for access. The pocket is attached to the garment in a waterproof and watertight fashion such that an individual wearing the garment may carry articles that may typically not be exposed to water or are in danger of being damaged if exposure or contact with water occurs. Such articles include various types of electronics, generally portable, such as cellular telephones, pagers, electronic organizers, and the like. Of course, other articles, such as paper and money, for example, may also be carried within the pocket of the garment of the present invention without risking damage thereto.

Figure 1:
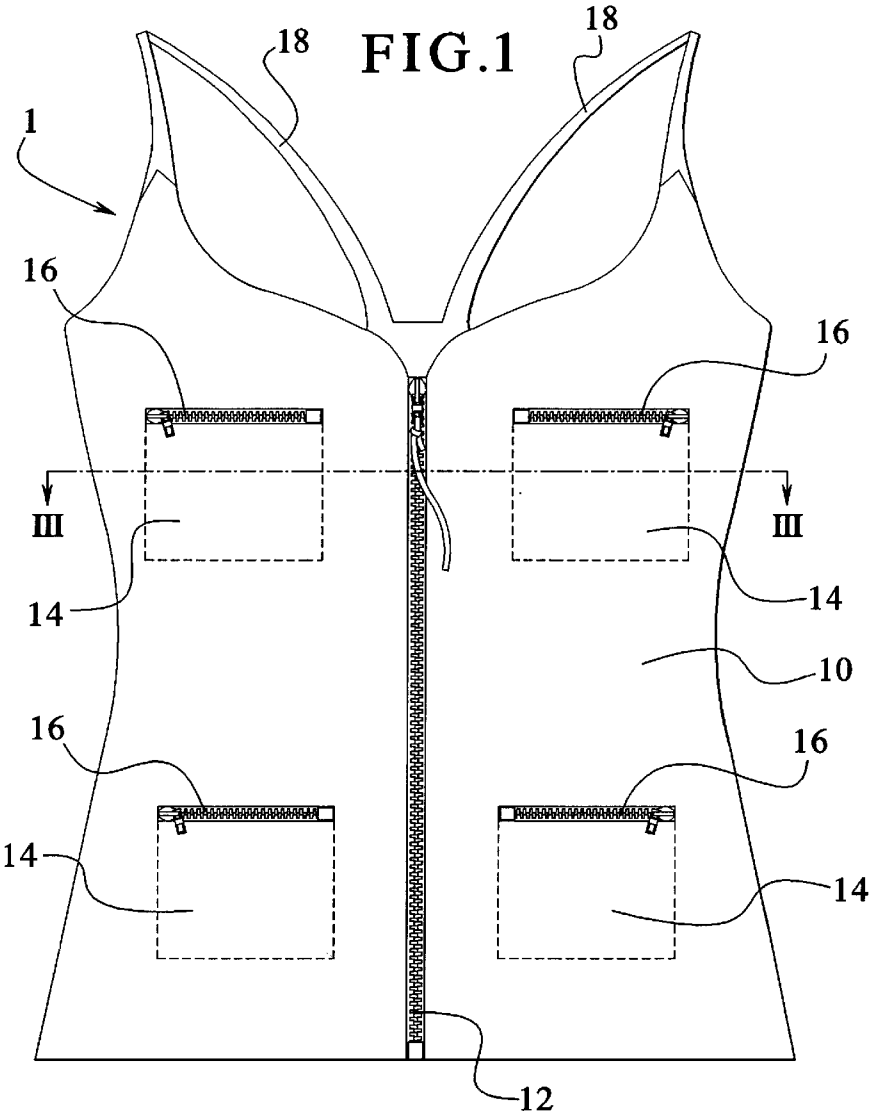
FIG. 1 illustrates a front view of a garment of the present invention having pockets associated therewith for holding articles therein in a waterproof and watertight fashion.

Referring now to the drawings wherein like numerals refer to like parts, FIG. 1 generally illustrates a garment 1 in the form of a strapped top. As shown, the garment 1 includes a front side 10 having a zipper 12; however, the front side 10 of the garment 1 may be integrally formed without the zipper 12. Preferably, the garment 1 is constructed from a neoprene material. As a result, the material of the garment 1 is somewhat elastic as an inherent property of the neoprene material of which the garment 1 is constructed.

As shown in FIG. 1, the garment 1 may include one or more pockets 14 located on the front side 10 of the garment 1. The location of the pockets 14 is not critical to the invention nor is the number of pockets 14. Each of the pockets 14 includes a zipper 16 for access to an interior of the pocket 14. The zipper 16 may be manufactured by Talon Corporation or YKK Corporation and is constructed, designed and manufactured to be waterproof and provide a watertight connection between the teeth of the zipper 16. Such zippers designed and constructed to be waterproof are generally known and available from at least one of Talon Corporation and YKK Corporation and are referred to as waterproof drysuit zippers. Such a zipper is shown and described with reference to FIG. 7. The zipper 16 and its attachment to the garment 1 provides access to the pocket 14 as well as a compartment that is one-hundred percent waterproof and watertight in nature allowing for articles to be placed in the interior of the pocket, such as electronic items, i.e. cellular telephones, pagers, personal electronic organizers, and the like, or other items such as money, and other like articles generally not capable of being immersed or subjected to water therein without concern for damage with respect thereto.

Figure 2:
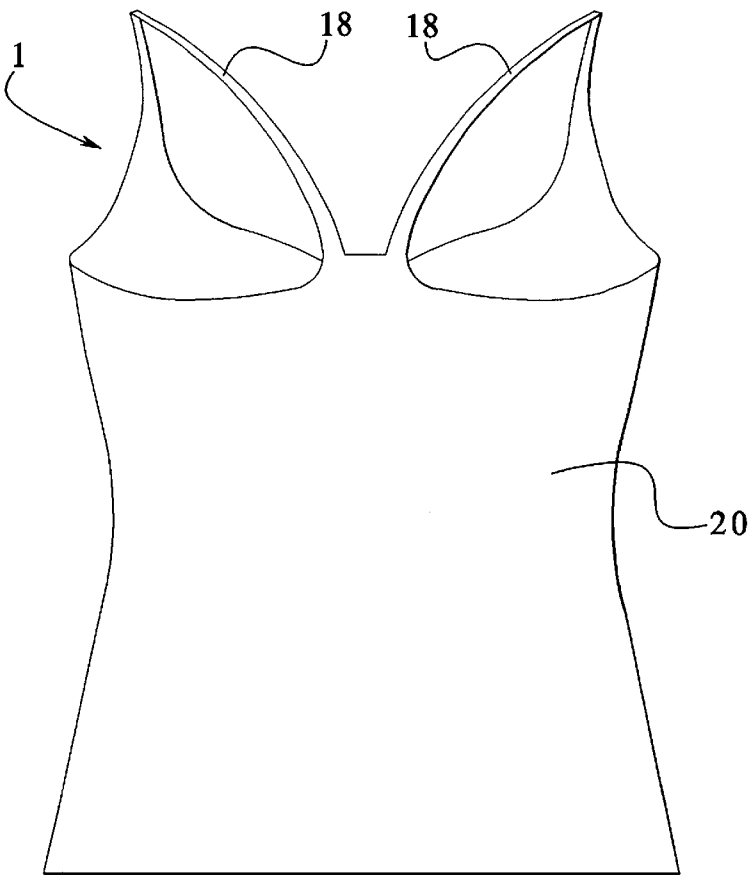
FIG. 2 illustrates a back view of an embodiment of the garment generally illustrated in FIG. 1.

As illustrated in FIGS. 1 and 2, the garment 1 includes straps 18 connecting the front side 10 of the garment to a back side 20 of the garment 1. The garment 1 is preferably, as previously indicated, constructed from a material such as neoprene. Preferably, neoprene having a thickness of 3.0 mm is used as at least one ply of the garment 1. Further, preferably, smooth skin neoprene is implemented, but a textured and/or patterned neoprene may also be used. Although the garment 1 is illustrated as a vest-like, tank-type top, the garment 1 may take many shapes that are particularly suitable as a bathing suit top for women. In addition, the garment 1 may be constructed such that it resembles a halter-type top in which, for example, the stomach of the individual wearing the garment is shown. Many other types of garments may, of course, be implemented such as the shirt-type garment shown and described with reference to FIG. 5. However, the specific type of garment is not necessarily limited by the present invention but the specific attachment of the pocket to the garment including the specific zipper necessary to maintain a one-hundred percent watertight and waterproof pocket for carrying articles that generally may not be exposed to or otherwise subjected to water.

Figure 3:
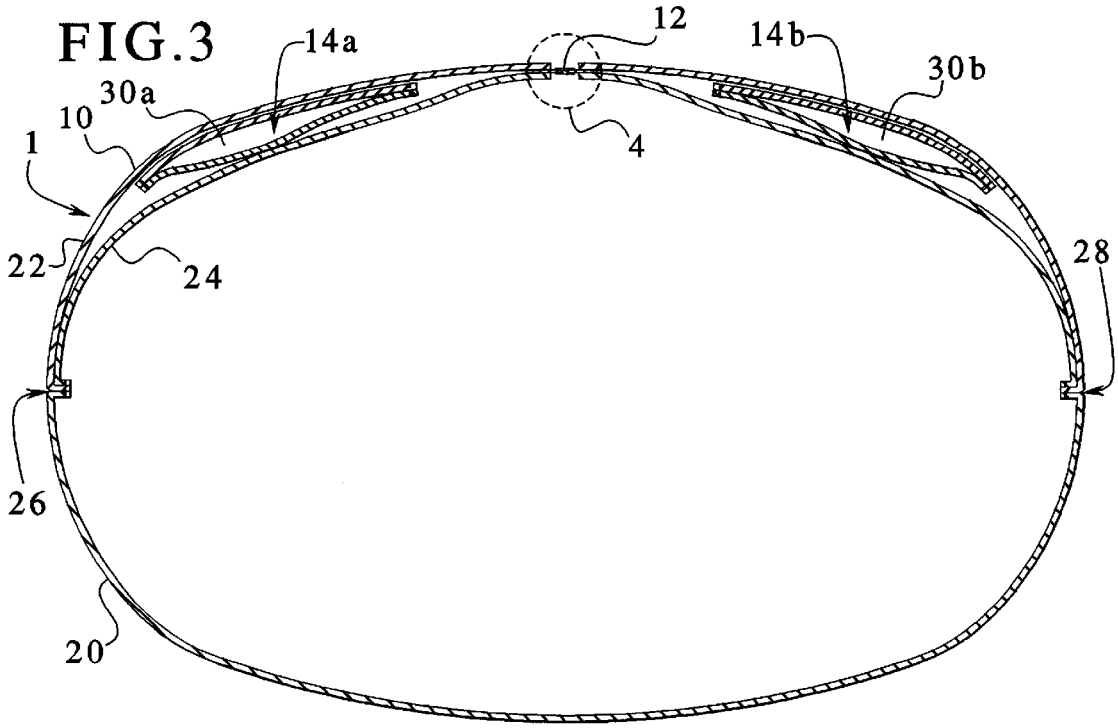
FIG. 3 illustrates a cross-sectional view taken generally along the line III—III of FIG. 1.
Figure 4:
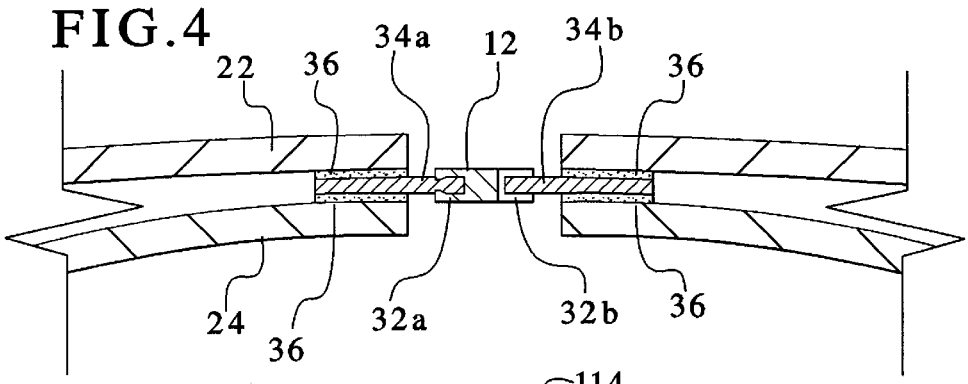
FIG. 4 illustrates an enlarged cross-sectional view of a zipper attached to an embodiment of the garment of the present invention in a waterproof fashion.

Referring now to FIG. 3, a cross-sectional view of the garment 1 including the relationship of the pockets 14*a*, 14*b* and the zipper 12 to the garment 1 is illustrated. An exploded view of a portion of the connection that includes the zipper 12 is shown in FIG. 4. Although FIG. 4 shows an exploded view of the zipper 12, the zippers 16 associated with the pocket 14 are attached in a like manner; however, the specific connection of the zippers 16 will be more specifically described with reference to FIG. 7 and the zippers associated with the embodiment shown in FIG. 5.

As illustrated in FIG. 3, the front side 10 of the garment 1 is constructed from a first ply 22 and a second ply 24 of a material, preferably neoprene which, in turn, connects, in combination, to the back side 20 at opposite sides 26, 28. The first ply 22, the second ply 24 and the back side 20 are preferably blind stitched forming a seam at the opposite sides 26, 28.

Between the first ply 22 and the second ply 24 are the pockets 14*a*, 14*b* having interior compartments 30*a*, 30*b*. The pockets 14*a*, 14*b* may be stitched around their peripheries forming the interior compartments 30*a*, 30*b*, respectively. Alternatively, the material forming the compartments 30*a*, 30*b* may be folded and stitched as required to form the compartments 30*a*, 30*b*. The pockets 14, like the garment 1, may also be constructed of neoprene material. As a result of the construction of the garment 1, the pockets 14*a*,14*b* are sandwiched between the first ply 22 and the second ply 24 of the front side 10 of the garment 1.

A zipper 16 may be attached at the opening to the pockets 14*a*, 14*b* in a manner shown and described with reference to FIG. 7. Although a zipper is shown and described with reference to the figures, other known fasteners capable of providing complete waterproofness and water tightness may be implemented. Nonetheless, the specific attachment of the zipper and its specific construction to create a waterproof pocket associated with the garment is the preferred embodiment.

FIG. 4 illustrates an enlarged view of a portion 4 of the attachment shown in FIG. 3 of the zipper 12 attached to the front side 10 of the garment 1 between the first ply 22 and the second ply 24. The attachment of the pockets 14 and the zippers 16 associated with the pockets 14 and the garment 1 will be described hereinafter with respect to FIGS. 5–7. As shown in FIG. 4, the zipper 12 includes teeth 32*a*, 32*b* connectable as shown and in a manner well-known in the art. The teeth 32*a*, 32*b* are connected to ends 34*a*, 34*b*, respectively, that are securable between the first ply 22 and the second ply 24 of the front side 10 of the garment 1. An adhesive 36 may be incorporated between the ends 34*a*, 34*b* and the first ply 24 and the second ply 24 to reinforce the attachment therebetween. The ends 34*a*, 34*b* may also be stitched to secure the attachment in addition to, or alternatively to, the adhesive 36.

Figure 5:
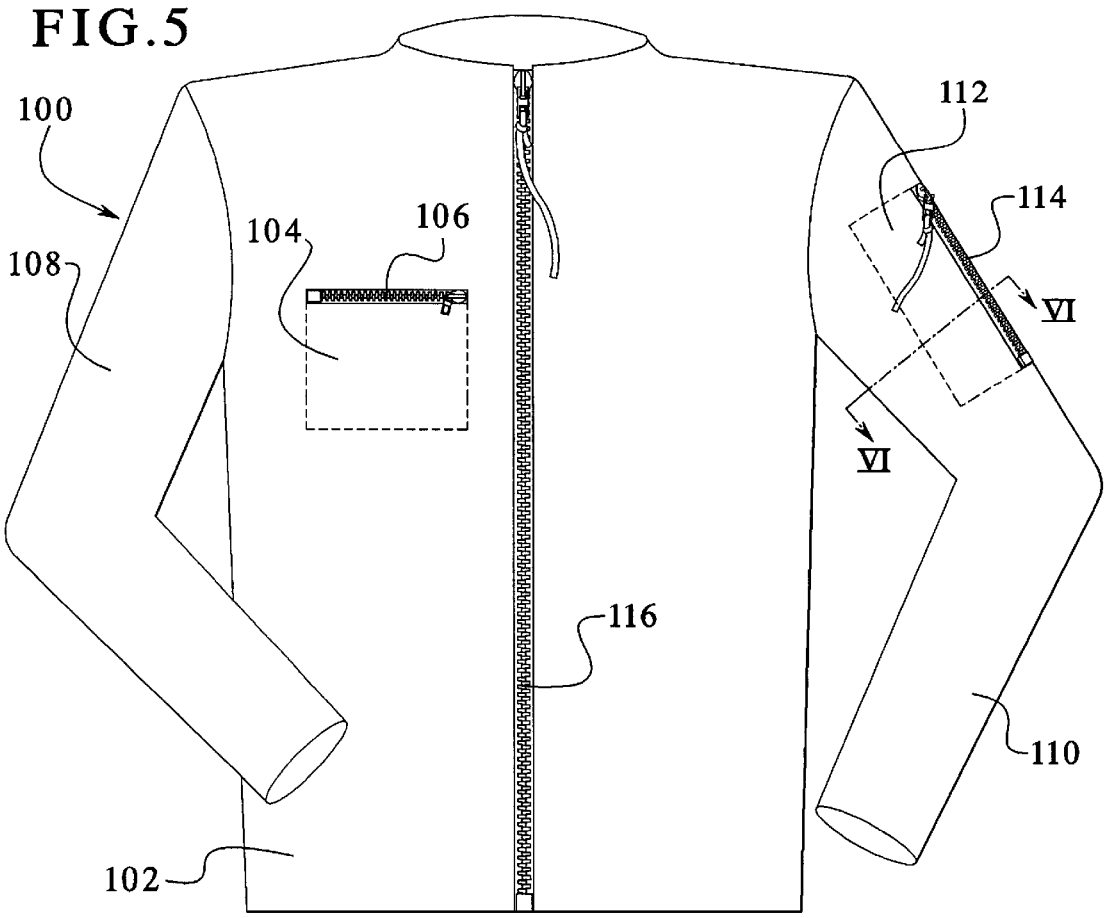
FIG. 5 illustrates a front view of an embodiment of another garment of the present invention having pockets associated therewith for holding articles therein in a waterproof and watertight fashion.

Referring now to FIG. 5, another embodiment of a garment 100 is generally shown. The garment 100, as illustrated, is in the form of a jacket. The garment 100 includes a front side 102 on which a pocket 104 is provided with a zipper 106 providing access to an interior of the pocket 104. The garment 100 includes sleeves 108, 110. Although the sleeves 108, 110 are shown as full-length sleeves, the sleeves 108, 110 may be of any length or even non-existent providing more of a vest-like garment. On one of the sleeves 110 is another pocket 112 also having a zipper 114 that provides access to an interior of the pocket 112.

The garment 100 is further shown with a zipper 116 extending along a length of the front side 102 of the garment 100. The zipper 116 may be attached to the garment similar to that shown and described with reference to FIG. 4 and the garment 1 illustrated in FIG. 1. Again, like the garment 1 illustrated in FIG. 1, the garment 100 is constructed from a material having elastic properties such as neoprene. The garment 100 is particularly suitable for use in activities performed in and around, for example, the water. The pockets 104, 112 provide one-hundred percent water-tight and waterproof interiors in which articles that may not normally be exposed to water to be placed therein without risk of damaging the products in the pockets 104, 112.

Figure 6:
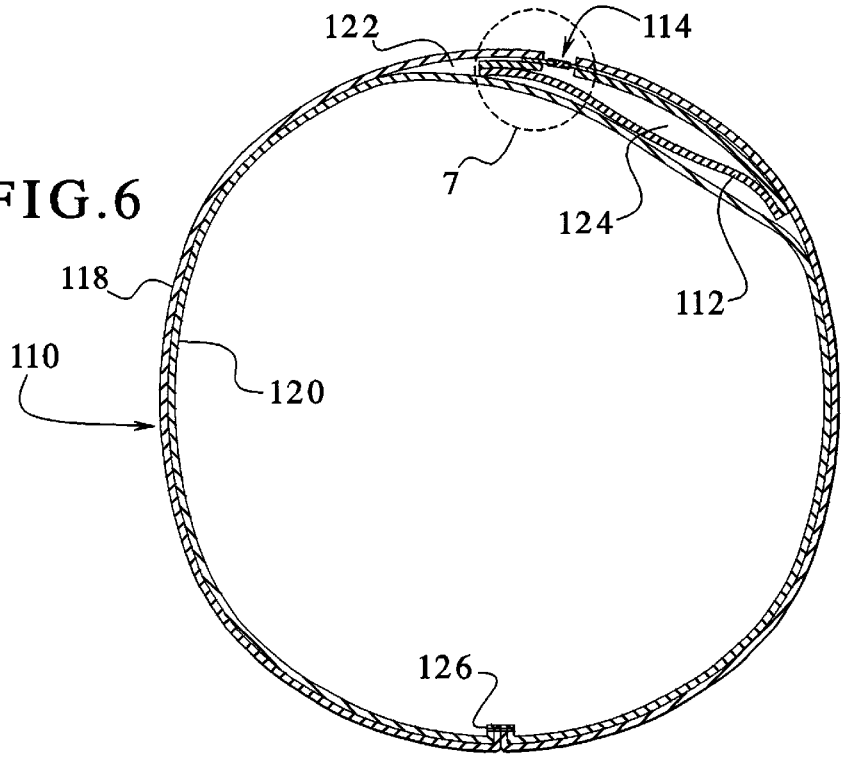
FIG. 6 illustrates a cross-sectional view taken generally along the line VI—VI of FIG. 5.

Referring now to FIG. 6, a cross-sectional view of the pocket 112 and the zipper 114 is shown in cross-sectional detail as attached to the sleeve 110 of the garment 100. An exploded view of a portion of FIG. 6 is illustrated more clearly in FIG. 7 showing the specific attachment of the zipper 114 to the pocket 112 and to the sleeve 110 of the garment 100. In FIG. 6, the sleeve 110 is shown having a first ply 118 and a second ply 120 with an opening 122 between the plies 118, 120 at a point in which the pocket 112 is inserted into the sleeve 110. The pocket 114 is similarly constructed to the pocket 104 and also similar to the pockets 14 shown and described with reference to FIGS. 1–3. That is, the pocket is preferably made from a material such as neoprene and may be folded or stitched to form an interior compartment 124 accessible by opening the zipper 114 or other waterproof fastener. The first ply 118 and the second ply 120 may be adhered together or otherwise attached in a known fashion and stitched at a point 126 as illustrated in FIG. 6.

Figure 7:
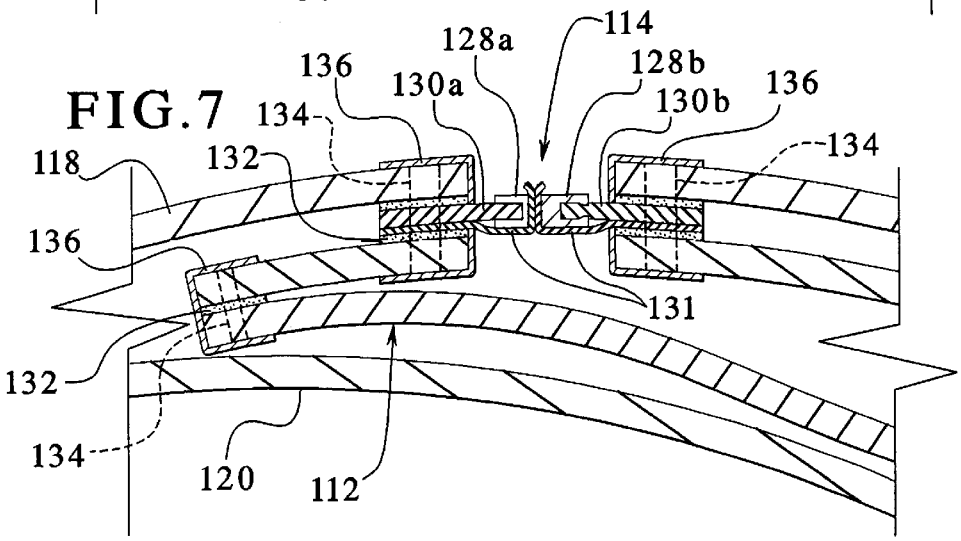
FIG. 7 illustrates an enlarged cross-sectional view of a zipper attached to an embodiment of the garment of the present invention in a waterproof fashion.

Referring now to FIG. 7, an enlarged view of a portion 7 of the attachment shown in FIG. 6 of the zipper 114 to the sleeve 110 and the pocket 112 is illustrated. The zipper 114 includes teeth 128*a*, 128*b* that are attached to ends 130*a*, 130*b*, respectively. The ends 130*a*, 130*b* are preferably made from rubber and may be attached between a layer of the pocket 112 and the first ply 118 of the sleeve 110. Attached to each of the ends 130*a*, 130*b* is a flap 131, also preferably made from rubber. The flaps 131 as shown are attached in a known manner to the ends 130*a*, 130*b*; however, the flaps 131 may be integrally connected to the ends 130*a*, 130*b*. The flaps 131 feed into the teeth 128*a*, 128*b* of the zipper 114 creating complete waterproofness in a zipped position of the zipper. As previously set forth, such zippers are known and available form Talon Corporation or YKK Corporation. The pocket 112 as illustrated in FIG. 7 is shown with an adhesive 132 that extends around its periphery except for the accessible opening provided at the point of the zipper 114.

The adhesive 132 may be used at all junctions and is preferably triple-glued externally, such gluing process being generally known in the art. Then, at the point at which the adhesive 132 may be applied to the pocket 112, a mauser-lock sewn blind stitch is applied through the layers of the pocket 112 as shown by the stitch 134 generally designated by the dashed lines in FIG. 7. Preferably, a polyurethane tape 136 may then be applied by heat sealing to cover all seams as shown in FIG. 7 to ensure one-hundred percent waterproofness at the points at which the adhesive 132 attaches to layers of the pocket 112 as well as a layer of the pocket 112 to the zipper 114 and, subsequently, to the first ply 118 of the sleeve 110. The heat sealable polyurethane tape 136 provides a final step to ensure complete waterproofness at all seams following application of the adhesive and the stitching, if necessary.

As a result of this gluing, stitching and/or heat sealing process in combination with a waterproof zipper 114 stitched and attached as shown, a completely one-hundred percent waterproof and watertight pocket 112 within the sleeve 110 of the garment 100 is provided. Likewise, the pocket 104 and the zipper 106 may also be similarly attached and secured to the front side 102 of the garment 100 to also provide a second waterproof and watertight pocket in which items may be carried without risk of damage due to water or the like. The technique or method used to apply and secure the pockets shown and described with reference to FIGS. 5–7 is identical to the process required to attach the pockets 14 and the zippers 16 of the garment 1 of FIG. 1.

It should be understood that various changes and modifications to the presently preferred embodiments described herein will be apparent to those skilled in the art. Such changes and modifications may be made without departing from the spirit and scope of the present invention and without diminishing its attendant advantages. It is, therefore, intended that such changes and modifications be covered by the appended claims.

I claim:

1. A garment to be worn by a user in an area of a body of the user between a neck and a waist of the user, the garment comprising:

a front side and a back side attached to form a shirt-type covering worn by the user on the area of the body between the neck and the waist of the user wherein the front side and the back side are attached to form openings at each end wherein the front side is formed of a top ply and a bottom ply;

an opening formed between the top ply and the bottom ply;

a pocket having an interior compartment suspended in the opening between the top ply and the bottom ply;

a fastener providing access to the interior compartment of the pocket, the fastener having a zipper having a set of teeth that interlock;

a plurality of ends, each of the plurality of ends having a first side and a second side wherein the first side is attached to the teeth of the zipper and further wherein the second side is positioned between the pocket and the top ply; and a plurality of flaps wherein each of the plurality of flaps is attached to each of the plurality of ends and further wherein a portion of each of the plurality of flaps is positioned within the set of teeth to provide waterproofness to the pocket.

2. The garment of claim 1 wherein the top ply and the bottom ply are neoprene.

3. The garment of claim 1 wherein the back side is formed of a single ply and is attachable to the top ply and the bottom ply of the front side.

4. The garment of claim 1 wherein the fastener is a waterproof zipper.

5. The garment of claim 1 further comprising:

an adhesive attaching the pocket to the front side.

6. The garment of claim 1 further comprising:

a heat sealable tape attaching the pocket to the the front side.

7. The garment of claim 1 further comprising:

stitching attaching the pocket to the front side.

8. The garment of claim 1 wherein the interior compartment of the pocket is formed by an adhesive around at least a portion of a periphery of the pocket.

9. A garment to be worn by a user in an area of a body of the user between a neck and a waist of the user, the garment comprising:

a shirt-type body worn by the user on the area of the body between the neck and the waist of the user, the body formed by a material having an outer surface and an inner surface;

a pocket attached to the body on the inner surface of the body having an interior compartment wherein the pocket is attached in a waterproof manner;

an opening in the outer surface of the body providing access to the pocket; and a fastener attached to the body providing access to the interior compartment of the pocket, the fastener having a zipper having a set of teeth that interlock;

a plurality of ends, each of the plurality of ends having a first side and a second side wherein the first side is attached to the teeth of the zipper and further wherein the second side is positioned between the pocket and the top ply; and a plurality of flaps wherein each of the plurality of flaps is attached to each of the plurality of ends and further wherein a portion of each of the plurality of flaps is positioned within the set of teeth to provide waterproofness to the pocket.

10. The garment of claim 9 further comprising:

sleeves formed with the body wherein the pocket is attached to one of the sleeves.

11. The garment of claim 9 wherein the fastener is a waterproof zipper.

12. The garment of claim 9 wherein the pocket is attached to the body by at least one of an adhesive, stitching or heat sealable tape.

13. The garment of claim 9 wherein the material of the body is neoprene.

14. The garment of claim 9 wherein the body has two layers of material in at least a portion of the body that includes the pocket wherein the pocket is formed between the two layers.

15. A method for providing a waterproof compartment associated with a garment worn by an individual on an area of the body between a neck and a waist of the individual, the method comprising the steps of:

providing a material to form a shirt-type garment to at least shape and fit a portion of a body of an individual on the area of the body between the neck and the waist of the individual wherein the material has an outside surface and an inside surface;

attaching a pocket to the inside surface of the material wherein the pocket is attached to the material by at least one of an adhesive, stitching or a heat sealable tape providing the waterproof compartment;

providing an opening in the outer surface of the material providing access to the pocket; and providing a fastener associated with the pocket providing access to an interior of the compartment, the fastener having a zipper having a set of teeth that interlock;

a plurality of ends, each of the plurality of ends having a first side and a second side wherein the first side is attached to the teeth of the zipper and further wherein the second side is positioned between the pocket and the top ply; and a plurality of flaps wherein each of the plurality of flaps is attached to each of the plurality of ends and further wherein a portion of each of the plurality of flaps is positioned within the set of teeth to provide waterproofness to the pocket.

16. The method of claim 15 wherein the fastener is a waterproof zipper.

17. The method of claim 15 wherein the material is neoprene.

18. The material of claim 15 wherein at least a portion of the material is two layers.

19. The method of claim 15 wherein the garment is a jacket having sleeves.

20. The method of claim 15 further comprising:

providing two layers of the material in at least a portion of the garment; and positioning the pocket between the two layers.

21. A garment comprising:

a body formed by a material having an outer surface and an inner surface;

a pocket attached to the body on the inner surface of the body having an interior compartment wherein the pocket is attached in a waterproof manner;

an opening in the outer surface of the body providing access to the pocket;

a fastener attached to the body providing access to the interior compartment of the pocket; and sleeves formed with the body wherein the pocket is attached to one of the sleeves.

22. A method for providing a waterproof compartment associated with a garment, the method comprising the steps of:

providing a material forming the garment, wherein the garment is a jacket having sleeves, to at least shape and fit a portion of a body of an individual wherein the material has an outside surface and an inside surface;

attaching a pocket to the inside surface of the material wherein the pocket is attached to the material by at least one of an adhesive, stitching or a heat sealable tape providing the waterproof compartment;

providing an opening in the outer surface of the material providing access to the pocket; and providing a fastener associated with the pocket providing access to an interior of the compartment.

* * * * *